US012680025B2

(12) United States Patent
Lepinay

(10) Patent No.: US 12,680,025 B2
(45) Date of Patent: Jul. 14, 2026

(54) PROCESS FOR GASIFYING A CARBON-CONTAINING SUBSTANCE BY MOLTEN SALT CATALYSIS, AND ASSOCIATED PLANT

(71) Applicant: CRYMIROTECH, Agny (FR)

(72) Inventor: Maxime Lepinay, Agny (FR)

(73) Assignee: CRYMIROTECH, Agny (FR)

( * ) Notice: Subject to any disclaimer, the term of this patent is extended or adjusted under 35 U.S.C. 154(b) by 350 days.

(21) Appl. No.: 18/552,713

(22) PCT Filed: Apr. 1, 2022

(86) PCT No.: PCT/FR2022/050620
§ 371 (c)(1),
(2) Date: Sep. 27, 2023

(87) PCT Pub. No.: WO2022/219260
PCT Pub. Date: Oct. 20, 2022

(65) Prior Publication Data

US 2024/0182786 A1 Jun. 6, 2024

(30) Foreign Application Priority Data

Apr. 16, 2021 (FR) ..... 2103945

(51) Int. Cl.
*C10B 49/14* (2006.01)
*C10B 53/07* (2006.01)

(52) U.S. Cl.
CPC ..... *C10B 49/14* (2013.01); *C10B 53/07* (2013.01)

(58) Field of Classification Search
CPC ..... C10B 49/14; C10B 53/07
See application file for complete search history.

(56) References Cited

U.S. PATENT DOCUMENTS

| | | | | |
|---|---|---|---|---|
| 11,923,742 | B2 * | 3/2024 | Kamizato | H02K 5/225 |
| 2015/0184079 | A1 * | 7/2015 | Riedewald | C10B 31/06 201/25 |

FOREIGN PATENT DOCUMENTS

| | | | |
|---|---|---|---|
| CN | 105385468 | B | 5/2017 |
| EP | 0070789 | A2 | 1/1983 |
| FR | 2156050 | A1 | 5/1973 |
| GB | 2106932 | A | 4/1983 |
| WO | 2014167139 | A2 | 10/2017 |

OTHER PUBLICATIONS

International Search Report from International Application No. PCT/FR2022/050620 dated Jul. 20, 2022, 3 pgs.
Zhang Jing et al. "Coordination and Thermophysical Properties of Transition Metal Chlorocomplexes in LiCI-KCI Eutectic" A, Journal of Physical Chemistry Part B, Aug. 12, 2021, pp. 8876-8887, vol. 125, No. 31, US. https://www.researchgate.net/publication/360327636_Coordination_and_Thermophysical_Properties_of_Select_Trivalent_Lanthanides_in_LiCI-KCI.

* cited by examiner

*Primary Examiner* — Randy Boyer
(74) *Attorney, Agent, or Firm* — Tutunjian & Bitetto, P.C.

(57) ABSTRACT

The present invention relates to a gasification process of a solid carbonaceous material by catalysis in molten salts. A carbonaceous material is contacted, for a defined period in the presence of air with a first molten salt bath. The first molten salt bath includes at least one chloride type salt chosen from NaCl, $MgCl_2$, $CaCl_2$, KCl, $FeCl_2$ and which has a melting point greater than or equal to 300° C., a density greater than 1 measured in the liquid state and at atmospheric pressure. The gases formed are recovered, and are contacted with a second molten salt bath optionally different from said first bath and, at the outlet of said second bath, the recovered gases are either stored optionally under pressure, or reinjected into said first bath or said second bath.

18 Claims, 2 Drawing Sheets

[Fig. 1]
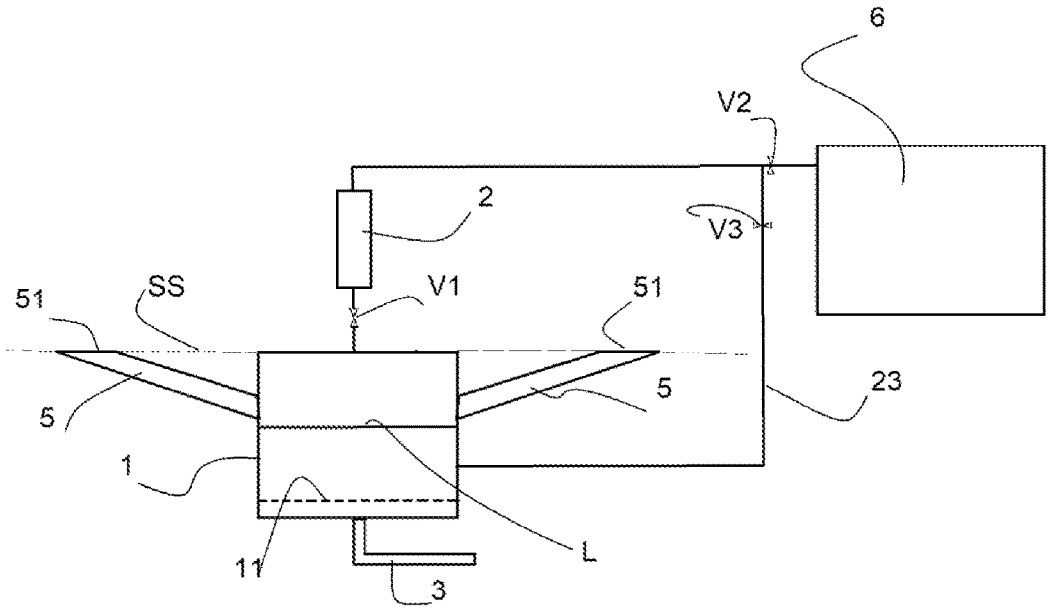
[Fig. 2]
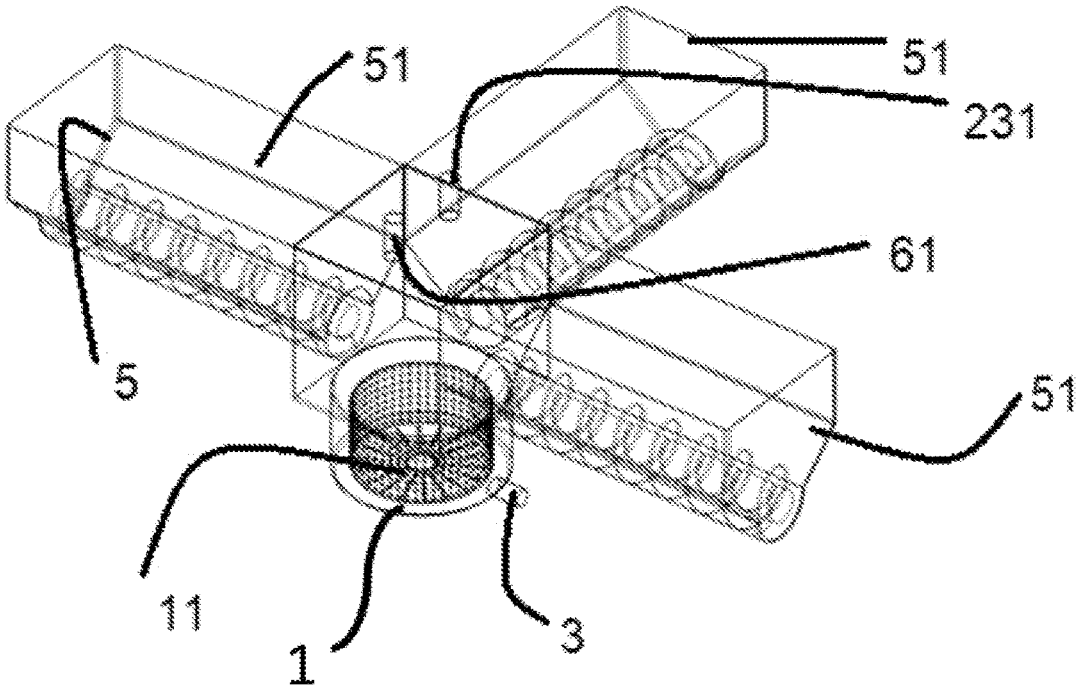

[Fig. 3]
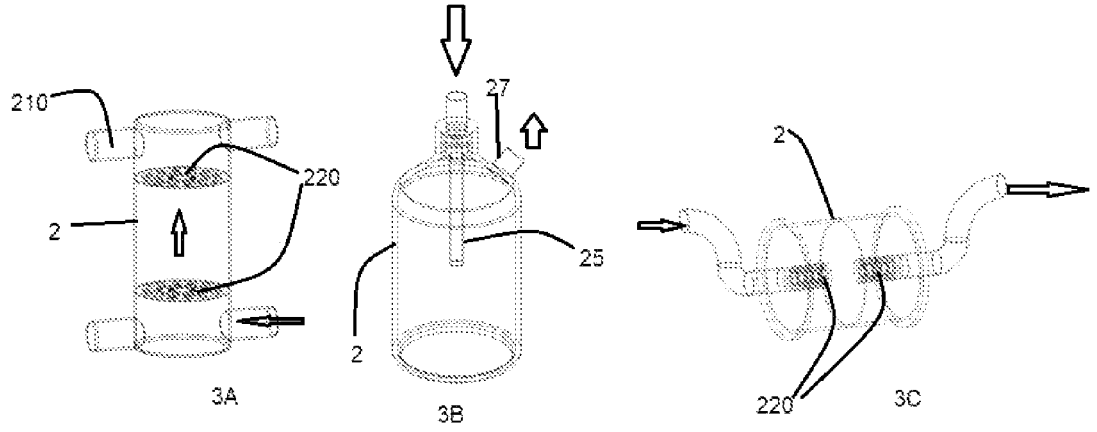

PROCESS FOR GASIFYING A CARBON-CONTAINING SUBSTANCE BY MOLTEN SALT CATALYSIS, AND ASSOCIATED PLANT

TECHNICAL FIELD

The present invention relates to the conversion of a carbonaceous material into gas, in particular into volatile hydrocarbons. The process can advantageously be applied to waste of varied origin and composition.

PRIOR ART

Waste materials particularly plastics, in particular thermosetting plastics and/or containing halogens are difficult to recycle. They are for the most part buried.

Processes for recycling plastic waste have nevertheless been proposed. Some use molten inorganic salts.

Thus, the document CN 105385468 A describes a process for recycling plastics using molten salts. To increase the contact surface area between the plastics to be processed, molten salts are sprayed onto plastic particles of less than 30 mm. The molten salts used are a mixture of sodium carbonate, potassium carbonate and other carbonates having a low melting point but above 50° C.

The document CN 102389888 A describes a process for recycling sheets of printed plates. The plates are ground and then immersed in a molten salt bath composed of sodium carbonate and/or potassium carbonate. Air is used as a gasifying agent. The temperature of the bath is from 900° C. to 1000° C.

The publication entitled "*Review of thermal processing of biomass and waste in molten salts for production of renewable fuels and chemicals*" published in the International Journal of low-carbon technologies in 2012 (volume 7, pages 318 to 324) describes the state of the art of pyrolysis and gasification of biomass by means of a molten salt bath. Halides are known to have a catalytic action on the cracking of some compounds. Alkaline metal carbonates are known to catalyze carbon gasification in the presence of steam and carbon dioxide. This publication also states that wood pyrolysis at 600° C.-900° C. has been carried out with a carbonate and chloride (NaCl and KCl) salt mixture. Lignin can be pyrolyzed in a mixture of $ZnCl_2$ and KCl at a temperature of the order of 500° C.-800° C.

With regard to waste, the publication cited above states that pyrolysis of household waste is possible at 870°-1000° C. in molten $Na_2CO_3$. Polyethylene, polystyrene and PVC have been pyrolyzed at a temperature between 640° C. and 850° C. in a molten mixture of $MgCl_2$ and KCl. The main products obtained are methane and ethylene. A eutectic mixture at a temperature of 420° C.-480° C. of NaOH and $Na_2CO_3$ also makes it possible to pyrolyze PVC, polystyrene, polypropylene and polyethylene. Plastic waste containing rubber has been pyrolyzed and converted to gas thanks to a liquid mixture of $NaCl/AlCl_3$ at 380° C.-570° C.

The same publication states that waste paper has been gasified in the presence of steam and carbon dioxide in a bath of molten carbonates at a temperature between 700 and 750° C. In the case of paper tissue type paper, mixtures of $Li_2CO_3$, $Na_2CO_3$ have been used. Lithium carbonate $Li_2CO_3$ makes it possible to obtain more $CO_2$. Alkaline metals in which the atoms are small have a greater catalytic power than others on account of the easy diffusion thereof in waste. Calcium tends nonetheless to limit the contact between paper and $CO_2$, thus lowering the reaction yield.

Other works have demonstrated the gasification of paper waste in the presence of $CO_2$ and a bath of molten carbonates at a temperature between 650° C. and 750° C. The presence of molten $Na_2CO_3$ makes it possible to catalyze the attack of $CO_2$ on the paper. The addition of $K_2CO_3$ and $LiCO_3$ increases the yield.

This publication also states that treatment plant sludge and rice were gasified by a bath of $Li_2CO_3$ and $K_2CO_3$ in the presence of carbon dioxide and at a temperature between 500° C. and 750° C. $SO_x$ compounds were nonetheless found in the gas phase generated.

The document FR 0 070 789 A2 describes a process for the destruction of organic materials containing sulfur and/or halogens and/or toxic metals. The bath used contains alkaline and alkaline-earth oxides and/or alkaline sulfates. The process is applied to the gasification of tires. The document FR 2 156 050 A1 describes a process for cracking a hydrocarbon material (hydrocarbons) in a molten salt bath. The bath contains either a mixture of lithium oxide, potassium oxide and boron oxide, or a mixture of phosphorus pentoxide and sodium oxide. Gaseous $C_3$ hydrocarbons are thus obtained. Gasification is performed with an air flow at atmospheric pressure.

The document GB 2 106 932 A1 describes a process for processing a solid or liquid hydrocarbon material such as coal, lignite, liquids derived from coal, bitumen, wood or other biomass or shale oil by means of a molten salt bath. The bath can contain the following salts: KCl, LiCl, NaCl, $CaCl_2$ or mixtures of carbonates.

The document WO 2014/167139 A2 describes a process for recycling plastics by means of a pyrolysis liquid, which can be a bath of molten non-ferrous metals containing at least zinc, tin, aluminum, lead, copper and alloys thereof.

Technical Problem Addressed

An aim of the present invention is that of providing a gasification process which makes it possible to reduce or suppress the formation of volatile oxygen compounds. Indeed, these compounds cannot be recovered and are considered as undesirable byproducts.

Another aim of the present invention is that of providing a gasification process of a carbonaceous material which is simple to implement, and in particular which can be implemented in air.

Another aim of the present invention is that of providing a process as cited above which does not use too much energy to arrive at the melting of the salt(s).

Another aim of the present invention is that of providing a gasification process which makes it possible to obtain mostly volatile hydrocarbons, in particular, pentane, propene, ethane and ethylene.

Another aim of the present invention is that of providing a process which makes it possible to obtain a small proportion (less than 8% by mass) of hydrocarbons including 7, 8, 9 or more carbon atoms.

Another aim of the present invention is that of providing a process which makes it possible to obtain at least 30% by mass of linear unsaturated hydrocarbons comprising between 2 and 4 carbon atoms (ethylene, propylene and butenes).

Another aim of the present invention is that of providing a gasification process which can be implemented with a large variety of carbonaceous material, which can be synthetic (plastics particularly thermosetting polymers, for example) or of organic origin (wood, cardboard, plant waste) or be of mixed origin (wet household waste including residues of organic material (food packaging)).

Another aim of the present invention is that of providing a process which does not necessarily require grinding of the carbonaceous material and which makes it possible to obtain volatile hydrocarbons even when the solid material is presented in the form of pieces of different sizes and particularly pieces of several centimeters or even around ten centimeters.

Another aim of the present invention is that of providing a process which proves to be effective even when the carbonaceous material is contained in plastic bags (heterogeneous carbonaceous material, such as for example, household waste comprising plants and plastics).

SUMMARY OF THE INVENTION

The present invention relates to a gasification process of a solid carbonaceous material by catalysis in molten salts whereby:

for a defined period, said carbonaceous material is contacted with a first molten salt bath which comprises at least one chloride type salt chosen from NaCl, $MgCl_2$, $CaCl_2$, KCl, $FeCl_2$ and has a melting point greater than or equal to 300° C., a density greater than 1 measured in the liquid state and at atmospheric pressure and a specific heat capacity measured in the liquid state and at atmospheric pressure always lower than the specific heat capacity of water measured at a temperature of 25° C. and at atmospheric pressure (i.e., lower than 4.18 kJ/kg·K), said contacting is carried out in the presence of air;

the gases formed are recovered.

Characteristically, according to the invention, said recovered gases are contacted with a second molten salt bath optionally different from said first bath and, at the outlet of said second bath, the gases are either stored optionally under pressure, or reinjected into said first bath or said second bath.

The pass in the second bath makes it possible to convert volatile oxygen compounds into alkanes, alkenes or alkynes which no longer include oxygen and are recoverable. If a pass in the second bath is not sufficient, it is possible to place the gaseous mixture recovered at the outlet of the second bath in the first bath or again in the second bath. The second bath can also be the first bath, in this case, there are two passes in the same enclosure containing the first bath.

The gaseous compounds containing oxygen can be formed in non-negligible quantities according to the nature of the carbonaceous material processed. Thus, if the carbonaceous material contains lignin or cellulose, the oxygen compounds are more numerous than in the case of plastic waste.

The second bath makes it possible to break down into hydrocarbons the organic compounds formed (such as ethanal, for example) by reacting with the oxygen contained in the air above the first bath.

Advantageously, said gases are contacted with said second bath by bubbling the gases in said second bath. Nevertheless, the contacting is not limited to bubbling.

Advantageously, said gases are introduced under the free surface level of the second bath and such that they pass through the greatest height of the bath. They can thus be injected from the bottom of the tank containing the second bath.

The density of the first bath allows good catalysis of the reaction, the carbonaceous material found mostly in the bath (between two waters) or floating on the bath.

Preferably, throughout the present patent application, the density and the specific heat capacity are measured at the melting point of the bath.

The reaction being capable of being performed in the presence of air, the process is simple to implement and does not require the presence of steam or carbon dioxide as processes of the prior art. The facility is also simpler to embody.

The bath preferably has a density lower than 2.2 which represents the maximum density of plastics. Thus, inert waste (rubble, brick, concrete, stones and others) will sink in the bath and may be readily removed.

The melting point of the first bath is preferably less than or equal to 650° C. This temperature makes it possible to obtain melting without excessive energy expenditure.

The fact that the specific heat capacity of the first bath is lower than that of water makes it possible to rapidly obtain the melting of salts and also obtain relatively rapid cooling which is advantageous when the process is implemented discontinuously (in batch mode).

The majority chloride is preferably sodium chloride. The first bath can also contain, as a chloride, only calcium chloride. It can also consist of sodium chloride.

The composition of the first bath is not limited according to the invention. It can furthermore contain at least one hydroxide chosen from LiOH, NaOH, KOH, $Ca(OH)_2$, $Fe(OH)_2$ and/or at least one oxide chosen from $K_2O$, $Na_2O$, CaO, $P_2O_5$ and/or at least one carbonate chosen from $Li_2CO_3$, $Na_2CO_3$, $K_2CO_3$, $CaCO_3$ and/or at least one nitrous compound chosen from $NaNO_2$ and $NaNO_3$.

Advantageously, when the first bath contains at least one carbonate, the mass carbonate content of the first bath is less than 10%. This proportion makes it possible to limit the melting point of the first bath while having a good catalytic activity.

Advantageously, said first bath contains at least one salt wherein the melting point is lower than the melting point of said chloride or than the lowest melting point of said chlorides. This salt mixture can partially separate into phases on solidifying, making it possible to limit corrosion of the tank. The tank containing the bath is advantageously made of stainless steel.

According to one advantageous embodiment of said first bath, it contains a chloride salt (preferably sodium chloride), a salt having a melting point lower than that of chloride and less than 5% oxide(s) and carbonate(s). Such a bath enables the implementation of the process according to the invention. The carbonate(s) are chosen from the carbonates cited above. The oxide(s) are chosen from the oxides cited above.

The composition of the second bath is not limited according to the invention. It can have a melting point greater than 300° C. and/or it can furthermore comprise at least one chloride different from sodium chloride. This second bath makes it possible to refine the conversion of the carbonaceous material previously gasified by the first bath. The gases will bubble in the second bath ensuring a rapid reaction. The volume of the second bath can be less than the volume of the first bath. Even if the melting point thereof is higher, as the volume thereof is lower, the energy expenditure to obtain melting remains reasonable. The second bath can also be heated by a portion of the heat emitted by the first bath.

According to one embodiment that can be combined with each of the embodiments cited above, said second bath contains at least one iodide and/or a fluoride. The iodide can be chosen particularly from LiI, NaI, KI, $AlI_3$, without being limited thereto. The fluoride can be chosen independently of the iodide from the following salts: LiF, NaF, KF, $CaF_2$, $MgF_2$, $Na_3AlF_6$, without being limited thereto-Thus, the second bath can also contain more than 10% by mass of at least one carbonate.

The pressure above said first bath can be equal to or greater than atmospheric pressure. It is advantageously equal to atmospheric pressure; the temperature above the first bath is for example at least 100° C.

Advantageously, the contacting between said first bath and said carbonaceous material is implemented in an enclosure containing air and rendered hermetic after introducing said carbonaceous material into said enclosure. It is thus possible to avoid using the second bath.

Oxygen is consumed at the start of the reaction and produces organic compounds containing oxygen atoms. These are small in quantity because the enclosure is closed and the quantity of oxygen reduced. Moreover, they can also be converted into hydrocarbons by recycling (second pass) in the first bath.

The reaction can also start in air and then be continued in a gaseous oxygen-depleted atmosphere (less than 20% by volume, advantageously). It is thus possible to limit the quantity of organic compounds containing oxygen formed.

The solid carbonaceous material is advantageously chosen from:

- solid waste containing or consisting of plastic(s) chosen from ABS, cellulose acetates (CA), polyamides, polybutylene terephthalate (PBT), polycarbonates, polyethylenes, PET, HDPE, PP, PVC, PTFE, LDPE, PMMA, poly formaldehydes (POM), PVACs, styrene-acrylonitrile copolymers, optionally expanded polystyrene, PEEK, thermoset resins, in particular silicones and mixtures of at least two of these plastics;
- waste containing or consisting of animal and/or plant-based organic material, optionally processed, in particular paper, cardboard, wood, plant waste; and—mixtures of these two types of waste; and
- the waste cited above, optionally in a mixture or contained in bags made of plastic chosen from ABS, cellulose acetates (CA), polyamides, polybutylene terephthalate (PBT), polycarbonates, polyethylenes, PET, HDPE, PP, PVC, PTFE, LDPE, PMMA, poly formaldehydes (POM), PVACs, styrene-acrylonitrile copolymers, optionally expanded polystyrene, PEEK, thermoset resins, in particular silicones and mixtures of at least two of these plastics It is thus possible to process household waste containing plastics and organic material just like construction waste, which often contains plastic heat-insulating materials. It is even possible to process mixtures of these types of waste.

The carbonaceous material is advantageously presented in the form of items of a few millimeters in thickness, such as for example, plastic bags, films or sheets. The surface area of these items is not limited. The carbonaceous material can nonetheless be presented in the form of items of several centimeters in thickness or diameter, within the limits of the size of the first bath. It can obviously be ground beforehand but this is not necessary.

Regardless of the mode of implementation of the process according to the invention, said contacting with said second bath is implemented in a closed enclosure containing a gaseous mixture containing 20% or less of oxygen, said gaseous mixture optionally being at a pressure lower than atmospheric pressure.

Advantageously, the pressure of the gaseous mixture located above the second bath is reduced before contacting with the recovered gases. The reduced oxygen content above the bath reduces the formation of oxygen compounds.

When said gases obtained from the first bath and recovered contain water vapor, said water vapor is condensed prior to the introduction thereof into said second bath.

Indeed, if the carbonaceous material contains water, the latter will be evaporated and will pass through the first bath. It is important to condense so as not to introduce it into the second bath.

The water present absorbs energy to be evaporated at the expense of the catalytic reaction; the presence of water therefore increases the energy consumption of the process The present invention also relates to a facility allowing the implementation of the process according to any one of the preceding claims.

This facility comprises:

- an enclosure containing a first salt mixture optionally in the molten state, said first salt mixture comprising at least one chloride type salt chosen from NaCl, $MgCl_2$, $CaCl_2$, KCl, $FeCl_2$, having a melting point greater than or equal to 300° C., a density greater than 1 measured in the liquid state and at atmospheric pressure and a specific heat capacity measured in the liquid state and at atmospheric pressure lower than the specific heat capacity of water measured at a temperature of 25° C. and at atmospheric pressure;
- means for heating said first mixture of salts enabling the melting thereof;
- at least one conveyor of carbonaceous material, which comprises an inlet whereby said carbonaceous material is introduced and an outlet disposed such that said material drops into said first bath;
- means for recovering gases which are connected to said enclosure and which open above the first bath; and
- a second reactor which comprises an inlet connected to said means for recovering gases and which is capable of containing a second molten salt mixture;
- heating means capable of melting said second salt mixture;
- heating means capable of melting said second salt mixture, said second reactor optionally including at least one screen for forming gas bubbles of given size and said second reactor including a first pipe which connects the outlet of said second reactor to a storage tank and optionally a second pipe which connects the outlet of said second reactor with a zone of said enclosure located under the surface of said first molten salt bath or to the inlet of said second reactor.

When said second reactor includes a tank containing said second molten salt mixture, said inlet of said second reactor is disposed below the level of the free surface of said molten salt mixture, which enables contacting by bubbling the recovered gases.

The enclosure and the second reactor have a sufficient size to contain a gas or a gaseous mixture in a volume located above the first bath. It is in this volume that the gaseous hydrocarbons generated will accumulate.

According to one embodiment that can be combined with each of the embodiments cited above, the second reactor comprises means for rendering it gas-tight and said facility comprises means acting as a pump for reducing the pressure of the gaseous mixture contained in said second reactor prior to the contacting of said second molten salt mixture with the recovered gases. Thus, if the second reactor comprises a tank containing the second bath, the means acting as a pump make it possible to reduce the pressure of the gas volume located above the free surface of the second bath prior to the contacting of the recovered gases before the second bath.

Regardless of the embodiment, the facility advantageously includes means for condensing water vapor and said condensation means are disposed upstream from said storage tank and/or on said second pipe and upstream from said first enclosure and/or said second reactor. Advantageously, the enclosure and/or second reactor furthermore comprise(s) means for isolating/closing said enclosure relative to the external environment. These means make it possible to prevent the gases produced from being discharged to the external environment and also prevent the formation of an excessively large quantity of oxygenated organic compounds, produced on account of the reaction with oxygen from the air. Means acting as a pump can also equip the enclosure containing the first bath, which makes it possible by reducing the pressure above the first bath (after introducing the waste to be processed and isolating the enclosure) to reduce the quantity of oxygen capable of reacting with the carbonaceous material.

The second reactor can be a liquid/gas exchange column operating co-currently or counter-currently.

According to one embodiment, the second reactor comprises a tank containing said second salt mixture and said inlet of said second reactor is disposed below the level of the free surface of said second salt mixture, preferably at the bottom of the tank.

The enclosure can include at the bottom, a removable grate for removing inert materials (rubble and other).

The facility according to the invention can be at least partially buried. Thus, at least the first bath can be buried in the ground. Only the inlets of the conveyors are accessible to enable the insertion of the carbonaceous material into the first bath. The second bath and/or the storage tank can also be buried.

It is obvious that all the features of molten salt baths cited with reference to the process according to the invention can be applied to mixtures of salts (molten or not) which can be used in the facility according to the invention.

Definitions

The terms "volatile hydrocarbons" denote saturated, unsaturated (alkene, alkynes), cyclic, unsaturated cyclic hydrocarbons having a vapor pressure of 0.01 kPa or more at a temperature of 293.15 K. It can consist more specifically of hydrocarbons that are saturated or unsaturated, optionally cyclic (also saturated or unsaturated) and including from 1 to 5 carbon atoms. They can optionally be branched and substituted by one or more radicals chosen from the following groups: methyl or ethyl.

The terms "carbonaceous material" denote any material containing carbon atoms, hydrogen atoms and optionally other atoms, of which oxygen, sulfur or halogen atoms, for example. In the sense of the invention, the organic material is a carbonaceous material.

The terms "solid carbonaceous material" denote a material in the divided state without any size restriction and capable of containing water or oils, water and oils being minority. A dispersion or an emulsion of carbonaceous material in a liquid (sludge) is not a carbonaceous material in the sense of the invention.

FIGURES

The present invention, the technical features thereof and the various advantages provided thereby will become more apparent on reading the following description, of a specific embodiment of the invention, presented by way of non-limiting example and which refers to the appended drawings wherein:

FIG. 1 represents a schematic view of a specific embodiment of the invention;

FIG. 2 represents a specific embodiment of the tank and the conveyors; and

FIG. 3 represents three alternative embodiments of the second molten salt bath.

DETAILED DESCRIPTION

With reference to FIG. 1, a specific embodiment of the facility and mode of implementation of the process according to the invention will be described. The facility includes an enclosure 1 which contains the first molten salt bath. The surface of the first liquid bath is represented by the line L. Heating means (not shown) make it possible to melt the initially solid salts and form a liquid phase, which forms the molten salt bath. The enclosure is provided with a draining pipe 3 which opens into the bottom of the enclosure, under the bath and makes it possible to drain the enclosure 1. The enclosure also includes a removable screen 11 which makes it possible to retain the solid materials which are not degraded by the bath. Two conveyors 5 lead to above the surface of the bath and make it possible to transport the waste deposited at the inlet 51 thereof into the bath. The enclosure 1 can be hermetically sealed at the outlet of the conveyors 5 by means for example of hatches or other. The facility includes a column 2 containing a second molten salt bath. A valve V1 makes it possible to regulate the gas flow from the enclosure 1 and entering the column 2. The outlet of the column 2 is connected to a storage tank 6 for pressurizing the gases. A valve V2 is used to regulate the gas flow entering the storage tank 6. Upstream from the valve V2, a bypass pipe 23 is located, which makes it possible to connect the outlet of the column 2 with the enclosure 1. The bypass pipe 23 opens into the enclosure 1, at a level located below the surface L of the first molten salt bath. A valve V3 equips the bypass 23 and is used to regulate the flow of recycled gases to the first bath. The dotted line SS represents the surface of the floor. In FIG. 1, the enclosure 1 is buried and the inlet 51 of the conveyors is flush with ground level. It is also possible to also bury the column 2.

A mode of implementation of the process according to the invention will now be described with reference to FIG. 1. The carbonaceous materials to be processed are carried, for example, by truck to the facility. They may consist of solid waste. Waste in the form of suspended solid particles in a liquid (sludge) cannot be processed with the process according to the invention. The waste is introduced into the conveyors 5 at the inlet 51 thereof. The conveyors 5 carry the waste into the enclosure and drop it into the first molten salt bath. The bath has been previously formed by melting the salts thanks to the heating means (not shown). According to the density thereof, the waste sinks into the bath or floats on the surface thereof. Inert waste (rubble, bricks, concrete, stones and others) which has a greater density than carbonaceous waste, in particular plastics, falls to the bottom of the bath and accumulates on the screen 11. It will subsequently be removed at the end of the process. After introducing the waste, the inlets 51 are hermetically sealed by means for example of hatches or other means and the salts are molten (batch operation). The enclosure 1 contains air located above the surface of the first bath. The cracking reaction of the carbonaceous material into hydrocarbons is catalyzed by the ions of the first bath. This reaction consumes the oxygen of the air contained in the enclosure 1, above the surface L of the first bath. The enclosure 1 being hermetic, the reaction starts in an air atmosphere. It then continues in an atmosphere that is oxygen-depleted, or even containing no more oxygen. The absence of oxygen increases the yield of hydrocarbons, particularly of volatile hydrocarbons, regardless of the type of carbonaceous material processed. The pressure above the first bath increases on account of the formation of hydrocarbons. When it reaches a given value which indicates that the enclosure contains mostly hydrocarbons (volatile or not), the value V1 is opened. The gases enter the column 2 containing the second molten salt bath. They then undergo a second catalytic degradation in this second bath. The second bath makes it possible to increase the volatile hydrocarbon yield. The second bath can be used in a column 2 wherein the gases to be processed are bubbled. The column 2 and the various alternative embodiments thereof will be described in more detail with reference to FIG. 3. In the column 2, the gases undergo a second degradation. At the outlet of the column 2, according to the composition of the outflowing gas flow, this flow is either directed (partially or completely) toward the storage tank 6. All or part of the flow can be redirected toward the first bath located in the enclosure 1 for a new processing. The gases are injected into the bath in order to pass through it in the form of bubbles and be once again degraded therein.

An embodiment of the process of the invention will now be described with reference to FIG. 1, in the case of waste containing plastics, optionally wet or partially covered with organic material (such as food packaging). The waste is introduced, for example, by a garbage truck into the conveyors 5. After introducing the waste, the inlets 51 are hermetically sealed by means for example of hatches or other means and the salts are molten. The waste is contained in plastic bags. The bags drop into the first molten salt bath. The bags sink immediately in the bath on account of the density thereof. The enclosure 1 communicates with the outside at the conveyors 5. The catalytic reaction is immediate and various gases are produced above the bath. The enclosure does not communicate with the outside. The enclosure optionally has a flange cover which is connected to the column 2 or to the tank 6. On account of the presence of oxygen in the air, ethanal type compounds are also produced at the same time as volatile hydrocarbons. The temperature above the bath is at least 100° C. when the temperature of the bath is 500° C. and the pressure is 1 bar. Once the pressure reaches a given value above the first molten salt bath, the gases produced are passed in the second molten salt bath. This second bath makes it possible to convert the compounds containing oxygen into volatile hydrocarbons. Analysis means mounted at the outlet of the column 2 make it possible to indicate the volatile hydrocarbon concentration of the gaseous mixture at the outlet of the column 2. If the composition is considered to be satisfactory, i.e., containing more than 90% by volume of volatile hydrocarbons, the gaseous flow is oriented toward the storage tank. Otherwise, the gaseous flow is oriented toward the first molten salt bath or toward the second molten salt bath according to the composition thereof and the compounds desirable to be degraded to volatile hydrocarbons (see Table 2).

With reference to FIG. 2, a specific embodiment of the enclosure 1 and the conveyors 5 will now be described. The elements in common with those of FIG. 1 are referenced the same. In FIG. 2, the enclosure 1 includes in the lower part thereof a cylindrical container 11 which contains the first bath (the liquid is not shown). The upper part of the enclosure is parallelepipedal and open to the outside via the conveyors 5. Three faces of this part are connected to a conveyor 5. The hatches are not shown. The catalytic reaction is always performed after introducing the waste, the hermetic closure of the inlets 51 and the melting of the salts. The outlet 61 is connected to the storage tank 6. The outlet 231 enables the recirculation of the gases formed toward the first bath. The entire facility does not necessarily include a second bath.

With reference to FIG. 3, three alternative embodiments of the second bath will now be described. It should be noted that the second bath is optional.

With reference to FIG. 3, the column 2 comprises two screens 220 disposed on top of one another along the height of the column. These screens make it possible to divide the gas flow to be processed into a bubble of given size. The black arrows indicate the gas circulation, from the bottom upward. The molten and therefore liquid salts circulate from the top downward from the inlet 210 to the outlet 211. The gases and the salts circulate at countercurrent. The bubbles promote and accelerate the catalytic reaction by increasing the contact surface area between the gases and the salts.

In FIG. 3, the second reactor contains the second bath. The reactor not being full, air can remain above the second bath short of filling the space unoccupied by the molten salt by an inert atmosphere. The gases are sent to the center of the reactor by the inlet pipe 25 so as to bubble in the second molten salt bath. The inlet pipe 25 is immersed in the bath and opens at the center of the reactor. After the reaction inside the second bath, the processed gases come out at the top of the reactor at the outlet 27.

With reference to FIG. 3, a third alternative embodiment will now be described. The second reactor 2 is horizontal and contains the second bath. Preferably, the second bath fills the second reactor 2 by half. The inlet and outlet pipes includes screens 220 which enable the formation of bubbles at the inlet and at the outlet of the reactor. The second salt bath is static as in the second alternative embodiment.

Example 1

The different types of waste indicated hereinafter in Table 1 were processed according to the process of the invention.

TABLE 1

| Type of waste processed | Name of gas sample | Gas sample receptacle | Sample analysis method |
|---|---|---|---|
| HDPE | Alpha 1 | 2 L multilayer bag | μGC/MS |
| HDPE and PP | Alpha 2 | 2 L multilayer bag | μGC/MS |
| HDPE, PP and PET | Alpha 3 | 2 L Tedlar ® bag | μGC/MS |

Tedlar® is a semi-crystalline thermoplastic polyvinyl fluoride.

Table 2 lists the non-methane VOCs produced by the process according to the invention during the processing of the plastics of Table 1 in the presence of air and in a closed reactor containing only the first molten salt bath at 500° C. (+/−20° C.).

TABLE 2

| List of hydrocarbons | Alpha 1 mg/(n)m$^3$ | Alpha 1 % by mass | Alpha 2 mg/(n)m$^3$ | Alpha 2 % by mass | Alpha 3 mg/(n)m$^3$ | Alpha 3 % by mass |
|---|---|---|---|---|---|---|
| Pentane | 206 | 1.57 | 31020 | 24.43 | 96981 | 35.18 |
| Propene | 1798 | 13.69 | 52886 | 41.65 | 96001 | 34.82 |
| Ethane | 318 | 2.42 | 9227 | 7.27 | 15991 | 5.80 |
| Ethylene | 1427 | 10.87 | 10450 | 8.23 | 12418 | 4.50 |
| Acetaldehyde | 1283 | 9.77 | 429 | 0.34 | 7454 | 2.70 |
| 2-Methylpentene | 591 | 4.50 | 2526 | 1.99 | 5375 | 1.95 |
| Hexene | 587 | 4.47 | 2526 | 1.99 | 5375 | 1.95 |
| 2-Butenal | 66 | 0.50 | 544 | 0.43 | 4242 | 1.54 |
| 2-Butene | 887 | 6.75 | 1847 | 1.45 | 3326 | 1.21 |
| Acrolein | 715 | 5.44 | 214 | 0.17 | 1633 | 0.59 |
| Methylcyclopentane | 75 | 0.57 | 348 | 0.27 | 1491 | 0.54 |
| Benzene | 694 | 5.28 | 583 | 0.46 | 1404 | 0.51 |
| Formaldehyde | 92 | 0.70 | 530 | 0.42 | 1360 | 0.49 |
| Isobutane | 212 | 1.61 | 147 | 0.12 | 1337 | 0.48 |
| 2-Hexanone | 47 | 0.36 | 627 | 0.49 | 1209 | 0.44 |
| Iso hexane | 254 | 1.93 | 372 | 0.29 | 1204 | 0.44 |
| 3-Pentanone | 252 | 1.92 | 836 | 0.66 | 918 | 0.33 |
| 2,4-Dimethylpentene | 4 | 0.03 | 139 | 0.11 | 833 | 0.30 |
| Ethylcyclopropane | 394 | 3.00 | 662 | 0.52 | 791 | 0.29 |
| n-Hexane | 217 | 1.65 | 717 | 0.56 | 787 | 0.29 |
| 1,3-Pentadiene | 66 | 0.50 | 343 | 0.27 | 634 | 0.23 |
| Toluene | 14 | 0.11 | 88 | 0.07 | 315 | 0.11 |
| Methyl Vinyl Ketone | 187 | 1.42 | 55 | 0.04 | 242 | 0.09 |
| Cyclopentene | 76 | 0.58 | 153 | 0.12 | 240 | 0.09 |
| 1,4-Cyclohexadiene | 23 | 0.18 | 59 | 0.05 | 236 | 0.09 |
| Acetone | 331 | 2.52 | 190 | 0.15 | 188 | 0.07 |
| Isobutene | 51 | 0.39 | 141 | 0.11 | 171 | 0.06 |
| Butanal | 295 | 2.25 | 112 | 0.09 | 144 | 0.05 |
| 2,4-Hexadiene | 30 | 0.23 | 126 | 0.10 | 133 | 0.05 |
| 1,3-Cyclohexadiene | 12 | 0.09 | 66 | 0.05 | 116 | 0.04 |
| Pentanal | 660 | 5.03 | 182 | 0.14 | 92 | 0.03 |
| 2-Pentanone | 121 | 0.92 | 122 | 0.10 | 75 | 0.03 |
| Cyclohexane | 5 | 0.04 | 41 | 0.03 | 44 | 0.02 |
| Methacrolein | 51 | 0.39 | 48 | 0.04 | 43 | 0.02 |
| Hexanal | 109 | 0.83 | 117 | 0.09 | 39 | 0.01 |
| THF | 40 | 0.30 | 20 | 0.02 | 19 | 0.01 |
| C7 alkane/acene isomers | 676 | 5.15 | 4141 | 3.26 | 3185 | 1.16 |
| C8 alkane/acene isomers | 223 | 1.70 | 2511 | 1.98 | 3086 | 1.12 |
| Alkane/alkene isomers ≥ C9 | 43 | 0.33 | 1824 | 1.44 | 6569 | 2.38 |
| TOTAL | 13132 | 100 | 126969 | 100 | 275701 | 100 |

The results of Table 2 shows that the majority volatile hydrocarbons produced are pentane, propene, ethane and ethylene using a catalyst containing only one chloride salt (sodium chloride in this case), a salt having a melting point lower than that of chloride and less than 5% of oxide(s) and carbonate(s).

Table 3 groups together the sum of certain hydrocarbons obtained.

TABLE 3

| List of hydrocarbons | Alpha 1 mg/(n)m$^3$ | Alpha 1 % by mass | Alpha 2 mg/(n)m$^3$ | Alpha 2 % by mass | Alpha 3 mg/(n)m$^3$ | Alpha 3 % by mass |
|---|---|---|---|---|---|---|
| Alkane/alkene isomers ≥ C7 | 942 | 7.17 | 8476 | 6.68 | 12840 | 4.66 |
| Ethylene, propylene and butenes | 4112 | 31.31 | 65183 | 51.34 | 111745 | 40.53 |

In the light of Table 3, it is observed that hydrocarbons comprising 7 and more carbon atoms respectively represent only 7.17%, 6.68% and 4.66% by mass of the hydrocarbons present in the samples Alpha 1, Alpha 2 and Alpha 3.

Linear unsaturated hydrocarbons with 2, 3 and 4 carbon atoms respectively represent 31.31%, 51.34% and 40.53% by mass of the hydrocarbons present.

The presence of oxygen enabled the production of aldehyde and ketones. These oxygen compounds can be broken down predominantly into hydrocarbons and carbon monoxide during the pass in the second bath, particularly by bubbling and therefore in the absence of oxygen.

The invention claimed is:

1. A gasification process of a solid carbonaceous material by catalysis in molten salts comprising:

contacting the carbonaceous material with a first molten salt bath for a defined period, said first molten salt bath comprising at least one chloride type salt selected from the group consisting of NaCl, $MgCl_2$, $CaCl_2$, KCl and $FeCl_2$ and having a melting point greater than or equal to 300° C., a density greater than 1 measured in the liquid state and at atmospheric pressure and a specific heat capacity measured in the liquid state and at atmospheric pressure lower than the specific heat capacity of water measured at a temperature of 25° C. and at atmospheric pressure, said contacting is carried out in the presence of air, recovering formed gases; and contacting the recovered formed gases with a second molten salt bath optionally different from said first bath and in that, at an outlet of said second bath, the received formed gases are either stored optionally under pressure, or reinjected into said first bath or said second bath.

2. The process according to claim 1, wherein said recovered formed gases are contacted with said second bath by bubbling the gases in said second bath.

3. The process according to claim 2, wherein said recovered formed gases are injected from a bottom of a tank containing the second bath.

4. The process according to claim 1, wherein said first bath furthermore contains at least one hydroxide selected from the group consisting of LiOH, NaOH, KOH, $Ca(OH)_2$ and $Fe(OH)_2$ and/or at least one oxide selected from a group consisting of $K_2O$, $Na_2O$, CaO and $P_2O_5$ and/or at least one carbonate selected from a group consisting of $Li_2CO_3$, $Na_2CO_3$, $K_2CO_3$ and $CaCO_3$ and/or at least one nitrous compound selected from a group consisting of $NaNO_2$ and $NaNO_3$.

5. The process according to claim 1, wherein said first bath contains at least one carbonate and in that a mass content of carbonate(s) is less than 10%.

6. The process according to claim 1, wherein said first bath contains at least one salt wherein the melting point is lower than a melting point of said chloride or than a lowest melting point of said chlorides.

7. The process according to claim 1, wherein said second bath has a melting point greater than 300° C. and/or in that it furthermore comprises at least one chloride different from sodium chloride.

8. The process according to claim 1, wherein said second bath contains at least one iodide and/or one fluoride.

9. The process according to claim 1, wherein said second bath comprises more than 10% by mass of at least one carbonate.

10. The process according to claim 1 wherein the contacting between said first bath and said carbonaceous material is implemented in an enclosure containing air and rendered hermetic after introducing said carbonaceous material into said enclosure.

11. The process according to claim 10, wherein said hermetic enclosure contains a gaseous mixture containing less than 20% by volume of gaseous oxygen.

12. The process according to claim 1 wherein said solid carbonaceous material is one selected from solid waste containing or consisting of plastic(s) selected from a group consisting of ABS, cellulose acetates (CA), polyamides, polybutylene terephthalate (PBT), polycarbonates, polyethylenes, PET, HDPE, PP, PVC, PTFE, LDPE, PMMA, poly formaldehydes (POM), PVACs, styrene-acrylonitrile copolymers, optionally expanded polystyrene, PEEK, thermoset resins, silicones and mixtures of at least two of these plastics, waste containing or consisting of animal and/or plant-based organic material, optionally processed, in particular paper, cardboard, wood, plant waste; and—mixtures of these two types of waste; and wherein the solid waste and waste cited above, optionally in a mixture or contained in bags made of plastic selected from a group consisting of ABS, cellulose acetates (CA), polyamides, polybutylene terephthalate (PBT), polycarbonates, polyethylenes, PET, HDPE, PP, PVC, PTFE, LDPE, PMMA, poly formaldehydes (POM), PVACs, styrene-acrylonitrile copolymers, optionally expanded polystyrene, PEEK, thermoset resins, in particular silicones and mixtures of at least two of these plastics.

13. The process according to claim 1, wherein said contacting with said second bath is implemented in a closed enclosure containing a gaseous mixture containing 20% or less of oxygen, said gaseous mixture optionally being at a pressure lower than atmospheric pressure.

14. The process according to claim 1, wherein said recovered formed gases from the first bath contain water vapor, said water vapor is condensed prior to introduction into the second bath.

15. A facility allowing the implementation of the process according to claim 1 wherein it comprises:

an enclosure containing a first salt mixture optionally in the molten state, said first salt mixture comprising at least one chloride type salt selected from a group consisting of NaCl, $MgCl_2$, $CaCl_2$, KCl and $FeCl_2$, having a melting point greater than or equal to 300° C., a density greater than 1 measured in the liquid state and at atmospheric pressure and a specific heat capacity in the liquid state and at atmospheric pressure lower than the specific heat capacity of water measured at a temperature of 25° C. and at atmospheric pressure;

a first heating source to heat said first mixture of salts enabling the melting thereof;

at least one conveyor of carbonaceous material, which comprises an inlet whereby said carbonaceous material is introduced and an outlet disposed such that said material drops into said first molten salt bath;

a valve for recovering gases which are connected to said enclosure and which open above said first molten salt bath; and a second reactor which comprises an inlet connected to said valve for recovering gases and capable of containing a second molten salt mixture;

a second heating source capable of melting said second salt mixture, said second reactor optionally including at least one screen for forming gas bubbles of given size and including a first pipe which connects an outlet of said second reactor to a storage tank and optionally a second pipe which connects the outlet of said second reactor with a zone of said enclosure located under a surface of said first molten salt bath or to the inlet of said second reactor.

16. The facility according to claim 15, wherein said second reactor includes a tank containing said second molten salt mixture and in that said inlet of said second reactor is disposed below a level of a free surface of said second molten salt mixture.

17. The facility according to claim 15, wherein said second reactor comprises means for rendering it gas-tight and in that said facility comprises means acting as a pump for reducing the pressure of the gaseous mixture contained in said second reactor prior to the contacting of said second molten salt mixture with the recovered gases.

18. The facility according to claim 15 further comprising means for isolating/closing said enclosure and/or said second reactor with respect to the external environment.

* * * * *